United States Patent [19]

Aegerter

[11] 4,171,618

[45] Oct. 23, 1979

[54] FLUID OPERATED MOTOR

[76] Inventor: Karl M. Aegerter, 953 Wanamaker Dr., Covina, Calif. 91724

[21] Appl. No.: 802,503

[22] Filed: Jun. 1, 1977

[51] Int. Cl.[2] ..... F01K 23/00

[52] U.S. Cl. ..... 60/716; 60/397; 60/370; 60/412; 91/265

[58] Field of Search ..... 60/369, 370, 397, 407, 60/411, 412, 484, 716, 721; 91/170 R, 182, 189, 194, 265, 313, 411 B, 415

[56] References Cited

U.S. PATENT DOCUMENTS

| | | | |
|---|---|---|---|
| 1,694,279 | 12/1928 | Oishei | 60/370 |
| 2,138,236 | 11/1938 | Horton | 60/397 X |
| 2,317,317 | 4/1943 | Waterman | 91/182 |
| 2,345,213 | 3/1944 | O'Shei | 60/397 |
| 2,622,399 | 12/1952 | Babitch | 60/370 |
| 4,018,050 | 4/1977 | Murphy | 60/370 |

*Primary Examiner*—Edgar W. Geoghegan

*Attorney, Agent, or Firm*—Fischer and Tachner

[57] ABSTRACT

A motor is provided of the piston or diaphragm type in which vacuum is constantly applied to one side of a piston or the like and air under pressure is constantly applied to the opposite side to drive the piston through a stroke. The vacuum and pressurized air may be obtained from sources outside the motor. A valve mechanism driven by the motor reverses the application of vacuum and air pressure when the piston reaches each end of its stroke so that power is continuously applied to both sides of the piston during both forward and reverse movement thereof. Different pistons are arranged out of phase with one another to provide a smooth flow of mechanical power. In one version, the motor drives an air pump having a vacuum inlet and an air pressure outlet, and by connecting such inlet and outlet to the valve mechanism, the motor will drive a load as well as itself. In another version, the motor has an internal combustion apparatus incorporated therewith.

6 Claims, 11 Drawing Figures

FIG. 8.
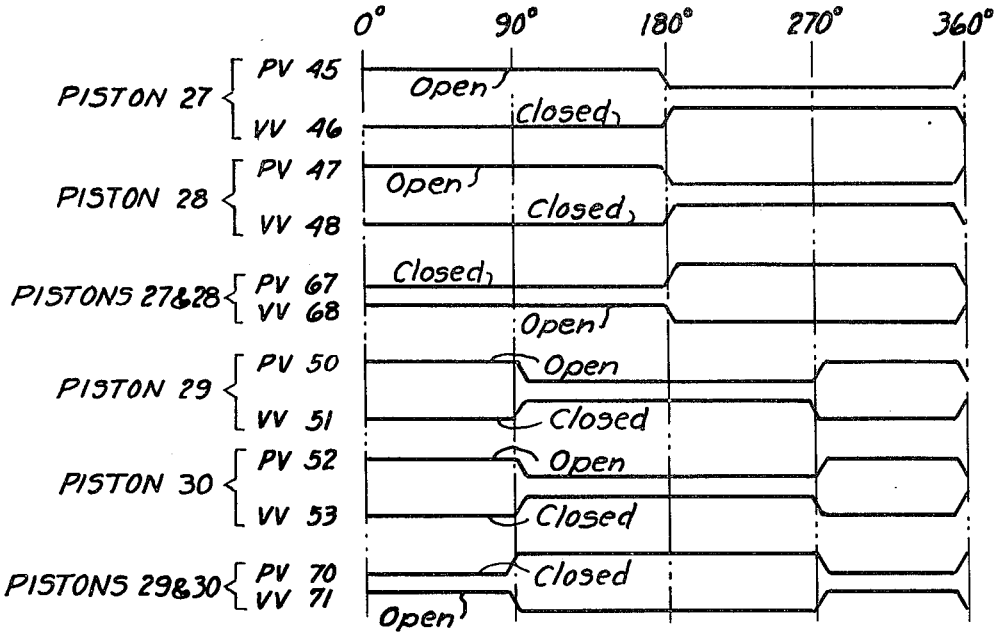
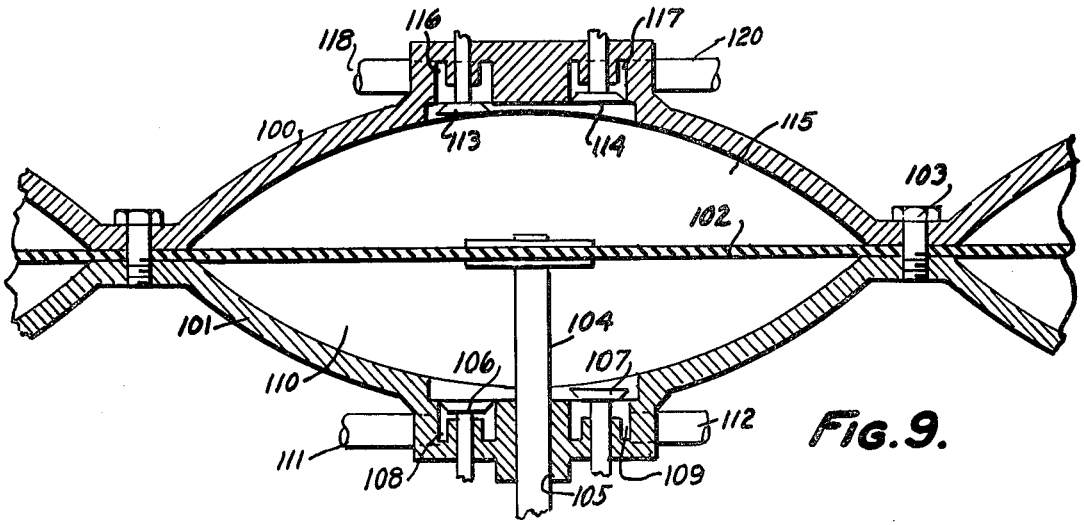
FIG. 9.

FIG. 10.
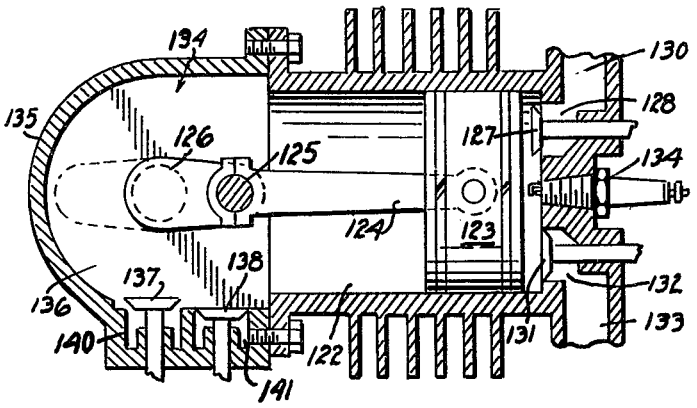
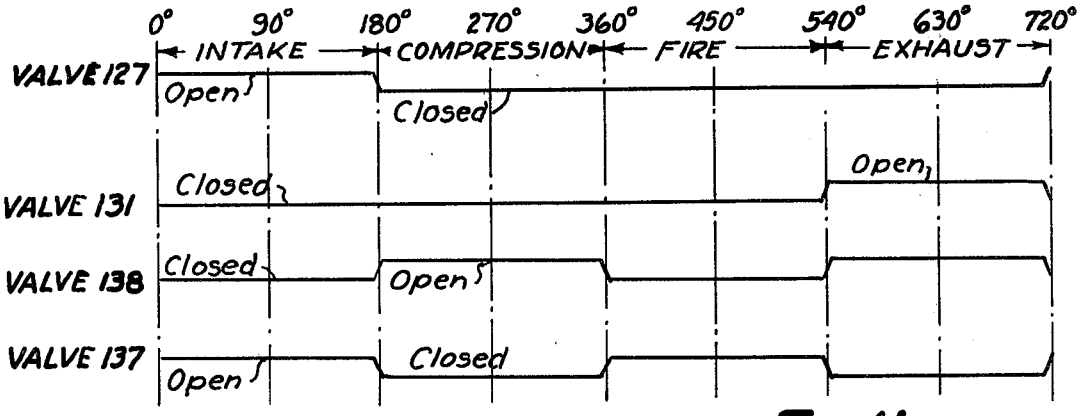
FIG. 11.

FLUID OPERATED MOTOR

BACKGROUND OF THE INVENTION

1. Field of the Invention

This invention relates to fluid driven motors and has particular reference to motors driven by combined pressurized air and vacuum or partial vacuum, or increased and decreased densities of air molecules.

2. Description of the Prior Art

Motors operated by compressed air or by an increase in the density of air molecules have been used heretofore in which case air under a pressure greater than that of atmospheric pressure is applied at appropriate times against one side of one or more drive pistons or their equivalents while the opposite side is subjected to normal atmospheric pressure to drive the motor. Other motors have been used in which air under atmospheric pressure is applied to one side of a piston or the like and the other side is subjected to air pressure below atmospheric pressure or a reduction in the density of air molecules to produce a net driving force.

On the other hand, attempts have been made to increase the efficiency of air driven motors, such as small windshield wiper motors or the like by subjecting a drive piston thereof, on one side, to air pressure greater than atmospheric pressure and, on the other side thereof, to a negative air pressure less than atmospheric pressure. The U.S. Pat. Nos. to Oishei 1,694,279 and O'Shei 2,345,213 disclose such motors. These motors have not proved satisfactory, however, because they derive motive power, at least partly, from suction or air pressure below atmospheric pressure which is developed in the intake manifold of an internal combustion engine in which the air pressure varies in accordance with certain operating conditions of the engine, such as varying load conditions. Therefore, such engines cannot produce constant power even though they were developed in an attempt to obtain such constant power. Also, such motors utilize relatively low air pressure or increase in air molecules and a low degree of vaccum or reduction of air molecules.

SUMMARY OF THE INVENTION

A principal object of the present invention is to provide a fluid driven motor having greatly increased efficiency and power.

Another object is to provide a gas driven motor utilizing as its power source, gas at pressures substantially above atmospheric pressure and gas at pressures substantially below atmospheric pressure.

Another object is to provide a gas driven motor capable of producing a large amount of power for a given size motor.

Another object is to provide a gas driven motor with means driven by the motor to apply air pressure and vaccum to the motor.

Another object is to provide a motor capable of driving itself.

Applicant has discovered that a substantial increase in efficiency and output power can be obtained in an air or other gas driven motor by applying a constant air pressure of several atmospheres or increase in density of air molecules to one side of a piston or its equivalent and a constant vacuum or reduction in density of air molecules in the neighborhood of 15 inches or less of mercury to the opposite side. This is particularly noticeable when the amount of vacuum is increased, as the power output is found to increase in other than a straight line relationship relative to the differential of the positive and negative air pressures applied to the piston. It is believed that this phenomenon is at least partly due to the reduction of resistance and friction within the motor.

Accordingly, the present invention comprises one or more cylinders or motor chambers with pistons, diaphragms or other air operated drive members operable therein which are subjected to air pressure on one side and vacuum on the opposite side, with valve means operable by the motor to alternate the pressurized air and vacuum when each piston or the like reaches the end of its stroke, thereby providing a continuous and smooth mechanical power output. It will be noted that this results in power being applied to both sides of each piston during both forward and reverse strokes thereof. Thus, air molecules are continuously added to one side of each piston and removed from the other and vice versa.

The pressurized air and vacuum can be derived from sources independent of the motor but this can be supplemented or even supplanted by a source, such as a vacuum and/or air pump, driven by the motor itself so that the air molecules are transferred from one side to the other of each piston.

The motor may be made in different forms. For example, three embodiments are disclosed, one showing a motor as being of a reciprocal piston driven type, another as a diaphragm driven type and a third as a combined internal combustion engine and pressurized air-vacuum motor.

BRIEF DESCRIPTION OF THE DRAWINGS

The manner in which the above and other objects of the invention are accomplished will be readily understood on reference to the following specification when read in conjunction with the accompanying drawings, wherein:

FIG. 8 is diagramatic view showing the relation between the timing of the various pressurized air and vacuum controlling valves.

FIG. 9 is a sectional view through a modified form of the invention embodying a diaphragm driven motor.

FIG. 10 is a sectional view through another modified form of the invention in which the motor of the present invention is provided with an internal combustion feature.

FIG. 11 is a diagrammatic view showing the timing of the various valves in the motor shown in FIG. 10.

DESCRIPTION OF THE PREFERRED EMBODIMENT

Figure 1:
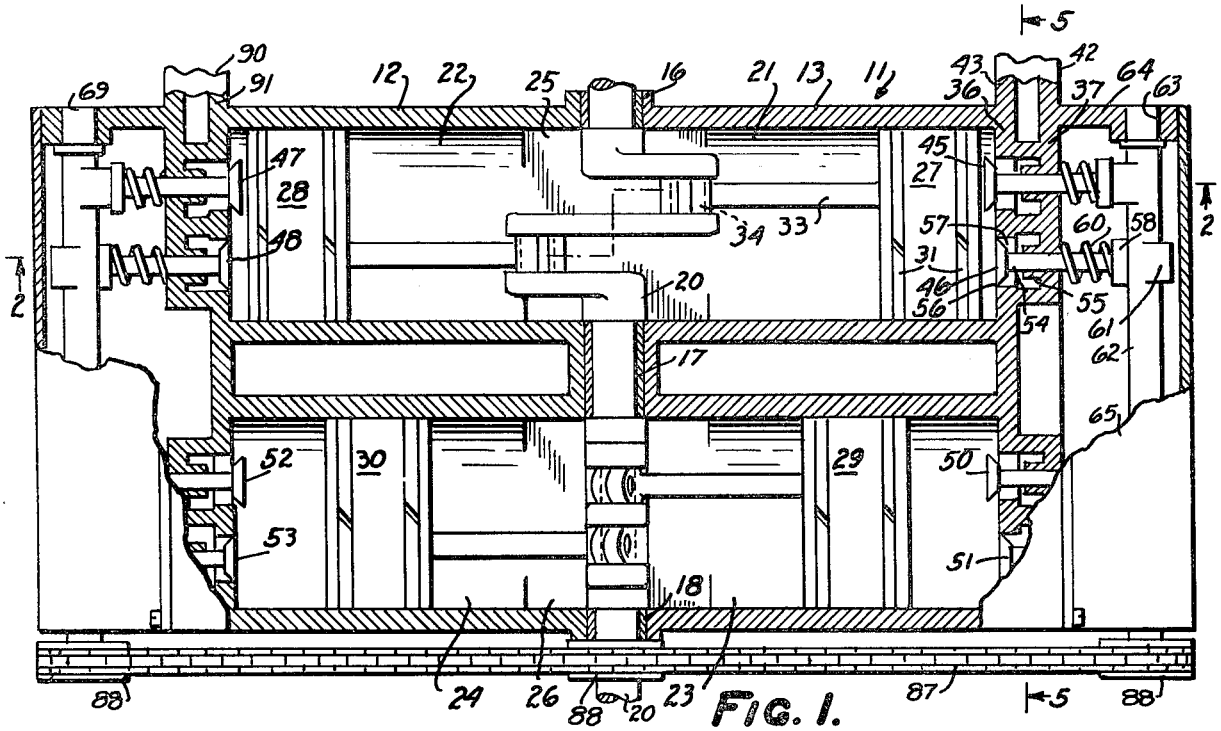
FIG. 1 is a sectional plan view through a piston driven motor embodying a preferred form of the present invention, and is taken substantially along line 1—1 of FIG. 2.

Referring in particular to FIGS. 1 to 8, the embodiment shown therein comprises an opposed cylinder type motor including a combined cylinder and crankcase block 11 which is divided into two halves 12 and 13 hermetically sealed together and having adjacent surrounding flanges 14 secured together by bolts 15. Both cylinder block halves have bearings 16, 17 and 18 fitted within semicircular openings to rotatably support a crankshaft 20. Two pair of axially aligned cylinders 21, 22 and 23, 24 are formed in the block 11. Such pairs of cylinders are coextensive with respective intermediate crankcase sections 25 and 26.

Pistons 27, 28, 29 and 30 are slidably mounted in respective ones of the cylinders 21 to 24. Such pistons are provided with piston rings 31 and pivotally connected at 32 to the outer edges of connecting rods 33 journalled at their opposite ends on associated crank pins 34 formed on the offset portions of the crankshaft 20.

Figure 2:
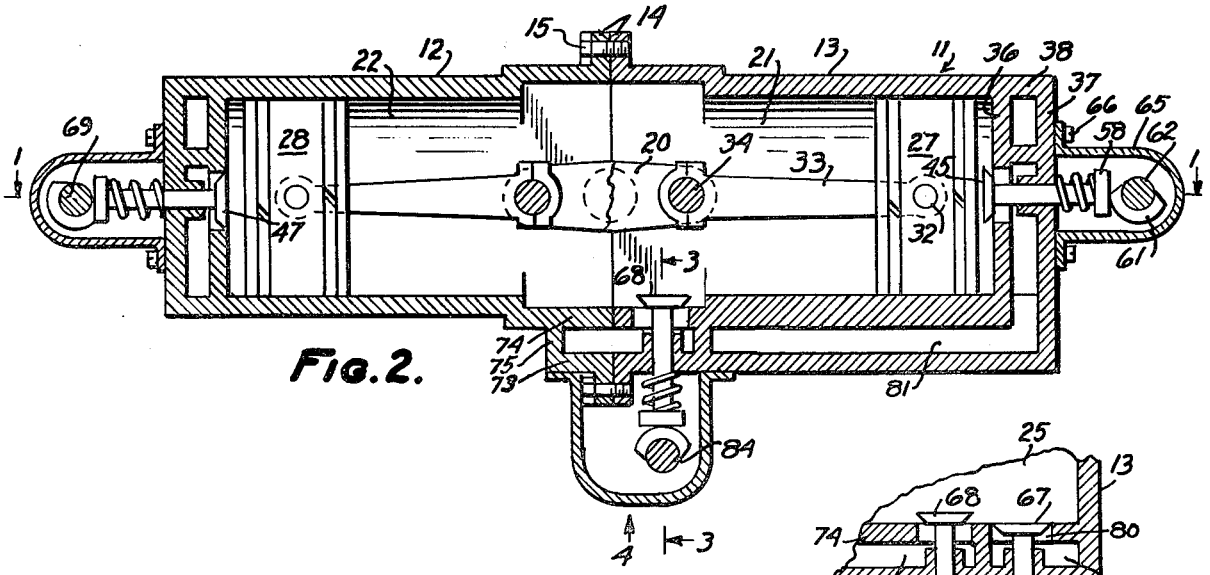
FIG. 2 is a sectional elevation view taken substantially along the line 2—2 of FIG. 1.

It will be noted that the crank pins 34 of the crankshaft 20 which are operatively associated with the aligned pistons 27 and 28, are located 180° apart and that the crank pins operatively associated with the pistons 29 and 30 are also arranged 180° apart but are offset at 90° with the first set of crank pins. Thus, as shown in FIGS. 1 and 2, the pistons 27 and 28 are depicted at top dead center, i.e. at the outer extremes of their respective strokes, while the pistons 29 and 30 are depicted half way through their respective strokes.

It will be further noted that the aligned cylinders, i.e. 21, 22 and 23, 24 of each pair are in alignment with each other but, along with their respective crankcase sections are hermetically sealed from the cylinders of the other pair.

Figure 5:
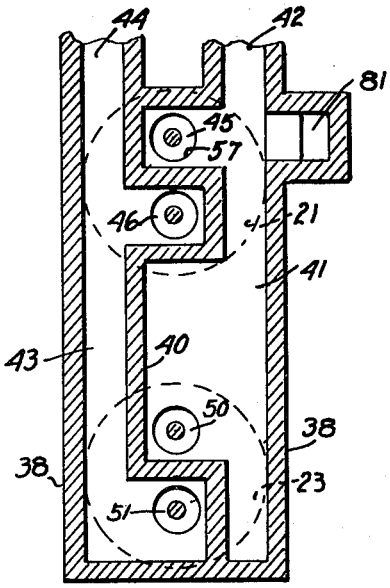
FIG. 5 is a sectional view taken along the line 5—5 of FIG. 1.

Each of the cylinder block halves 12 and 13 has an integral head portion comprising two spaced head walls 36 and 37 with side walls, i.e. 38, FIG. 5, and a labyrinth wall 40 dividing the space therebetween to form a pressure chamber 41 to receive pressurized air from an inlet 42 and a vacuum chamber 43 connected to a vacuum connection 44.

A pair of outer valves are provided for each cylinder, such valves, i.e. 45, 46 for cylinder 21, valves 47, 48 for cylinder 22, valves 50, 51 for cylinder 23 and valves 52, 53 for cylinder 24 are of the poppet type, each having a stem 54 slidable endwise in a bearing 55 formed in the outer head wall 37 and having a head movable into and out of engagement with a valve seat 56 surrounding a port 57 formed in the inner head wall 36. Each valve stem has a cam follower cap 58 secured to the outer end thereof and a compression spring 60 is interposed between the cap and outer wall 37 to yieldably hold the cam follower against a cam 61. The cams 61 for the valves 45, 46, 50 and 51 of the right hand bank are formed on a cam shaft 62. The latter is journalled in bearings, i.e. 63, formed in brackets 64 integral with respective cylinder block halves 12 and 13. A cam cover 65 is secured to the outer head wall 37 by screws 66. The similar cams for the valves 47, 48, 52 and 53 of the left hand bank are formed on a second cam shaft 69.

As shown particularly in FIG. 5, the ports 57 of valves 45 and 50 associated with cylinders 21 and 23, respectively, open into the pressure chamber 41 and the ports of the valves 46 and 51 associated with cylinders 21 and 23, respectively, open into the vacuum chamber 43.

Figure 3:
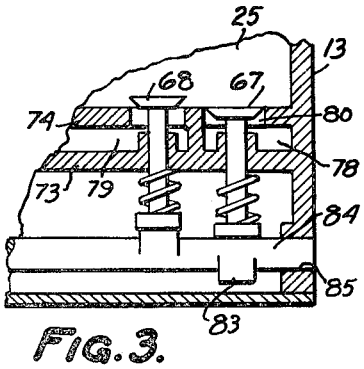
FIG. 3 is a fragmentary sectional view showing certain of the valves for one of the cylinders and is taken along the line 3—3 of FIG. 2.
Figure 4:
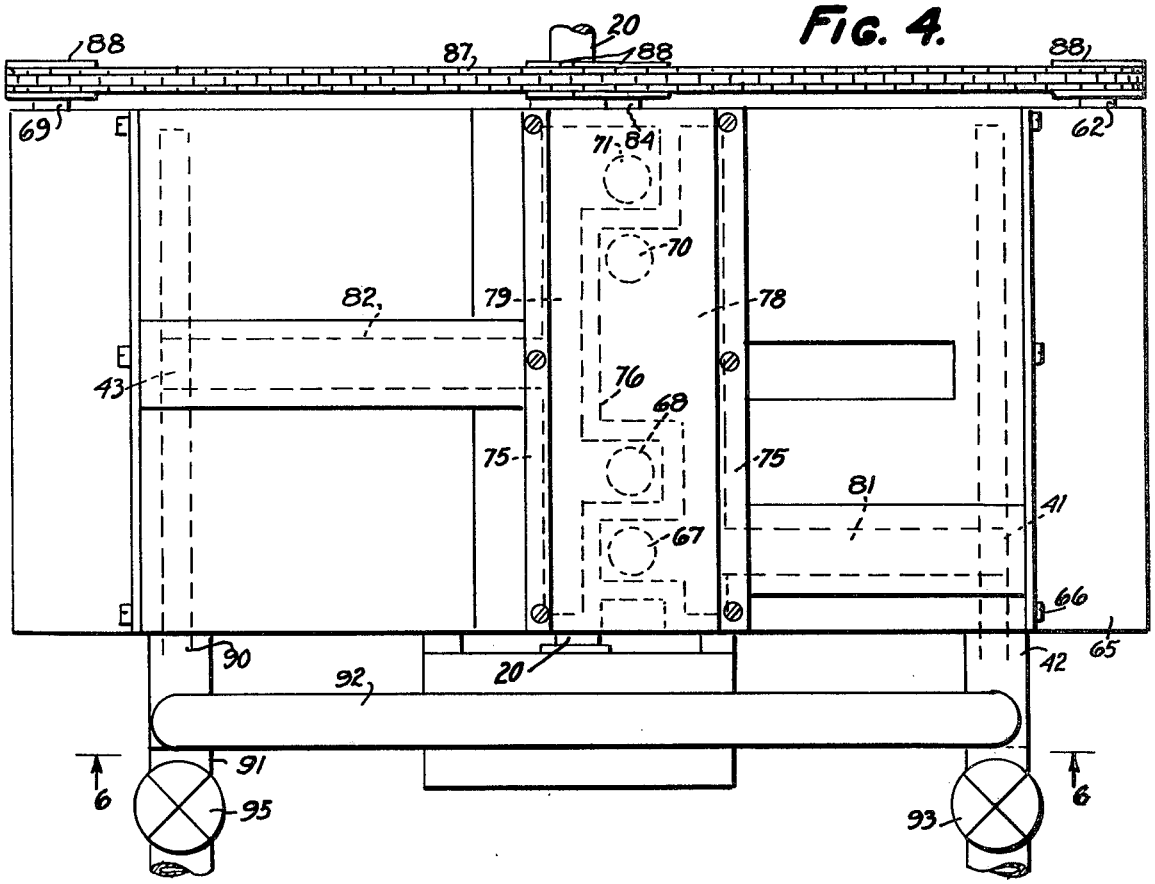
FIG. 4 is a bottom plan view taken in the direction of the arrow 4 in FIG. 2.

Referring to FIGS. 2, 3 and 4, an additional pair of valves 67 and 68 are provided for the crankcase section 25, common to cylinders 21 and 22, and another pair of valves 70 and 71 are provided for the crankcase section 26, common to the cylinders 23 and 24. Such valves 67, 68 and 70, 71 are mounted in a manner similar to that described above for the valves 45, 46, etc., and for this purpose, a wall 73 is spaced downwardly from the wall 74 forming the underside of the cylinder block halves 12 and 13. A surrounding wall 75, and an inner labyrinth wall 76 divide the space between the walls 73 and 74 into a pressure chamber 78 and a vacuum chamber 79. The port, i.e. 80, of valve 67 and a similar port of valve 70 open into the pressure chamber 78 while the ports of valves 68 and 71 open into the vacuum chamber 79. Pressure chamber 78 communicates with the pressure chamber 41 through a passage 81 and vacuum chamber 79 communicates with the vacuum chamber 43 of the left bank of cylinders through a passage 82.

The valves 67, 68, 70 and 71 are controlled by cams 83 formed on a cam shaft 84 rotatably mounted in bearings 85.

All three cam shafts 62, 69 and 84 are driven in synchronism with the crank shaft 20 by an endless chain 87 which is engaged around sprockets, i.e. 88, of the same diameter and fastened to the crank shaft 20 and the cam shafts 62, 69 and 84.

Figure 6:
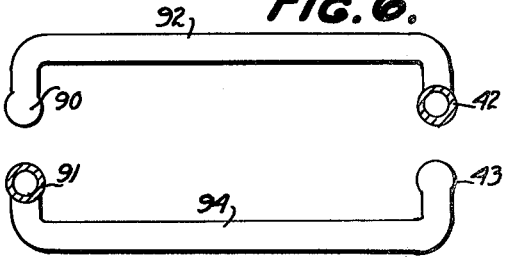
FIG. 6 is a sectional view showing one form of the pressurized air and vacuum source and is taken along the line 6—6 of FIG. 4.

Describing first the embodiment shown in FIG. 6, the pressure outlet connection 42 of the right hand bank of cylinders and the similar pressure outlet connection 90 of the left hand bank of cylinders are connected together by a conduit 92 and to a suitable source, not shown, of pressurized air through a shut-off valve 93. On the other hand, the vacuum connection 43 of the right hand bank of cylinders and the similar vacuum connection 91 of the left hand bank of cylinders are connected together by conduit 94 and to a suitable source, not shown, of vacuum through a shut-off valve 95. Accordingly, when the valves 93 and 95 are open, pressurized air will be applied to the valves 45, 47, 50, 52, 67 and 70 while vacuum will be applied to the remaining valves 46, 48, 51, 68 and 71.

Timing of the various valves in relation to rotation of the crankshaft 20 is shown in FIG. 8 wherein it will be noted that each piston is constantly driven during both forward and return strokes thereof by both vacuum and pressurized air. For example, from 0° to 90°, valves 45, 47, 50 and 52 are open, applying pressurized air to the outer ends of all of the pistons 27, 28, 29 and 30, respectively. Concurrently, valves 68 and 71 are open, applying a vacuum to the inner ends of the various pistons. At 90°, as the pistons 29 and 30 reach their inner dead center positions, the valves 51 and 53 open to apply vacuum to the outer ends of pistons 29 and 30. At this time, valve 70 opens to apply pressurized air to the inner ends of such pistons to cooperate with vacuum applied to the outer ends of these pistons to return the same outwardly. A similar procedure occurs when the pistons 27 and 28 reach their inner dead center positions, and a reverse of such procedure occurs when each pair of pistons reach their outer dead center positions.

Figure 7:
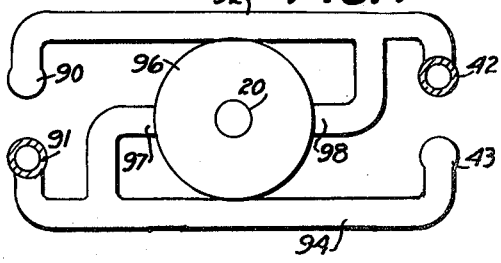
FIG. 7 is a sectional view, similar to that of FIG. 6, but showing a modified form of pressurized air and vacuum source.

Describing now the embodiment shown in FIG. 7, the latter retains the conduits 92 and 94 connecting the pressurized air and vacuum connections of the right and left hand cylinder banks. However, an air pump 96 is provided which is driven by the crank shaft 20 and has a vacuum inlet 97 connected to conduit 94 and an air pressure outlet 98 connected to conduit 92. Thus, the pump 96 applies air pressure to conduit 92 and vacuum to conduit 94. Accordingly, the pump 96 may be employed to supplement the air pressure and vacuum obtained from outside sources through the valves 93 and 95, respectively, or the valves 93 and 95 may be shut-off completely, enabling the pump 96 to supply the necessary pressurized air and vacuum to drive the motor.

FIG. 9 illustrates the invention embodied in a diaphragm type air motor comprising banked hemispheroidal chamber walls 100 and 101. A flexible diaphragm 102 is clamped between the walls 101 and 102 by bolts 103 to form a series of diaphragm sections. A drive rod 104 is attached to each operating portion of the diaphragm 102. The rod 104 is slidably mounted in a bearing 105 formed in the lower wall 101 and is operatively connected in a manner not shown to a suitable crankshaft. Poppet valves 106 and 107 are slidably mounted in bearings formed in the wall 101 to open and close ports 108 and 109 communicating each lower diaphragm chamber 110 with a pressurized air conduit 111 and with a vacuum conduit 112, respectively.

Similarly, poppet valves 113 and 114 are provided in the wall 100 of each upper diaphragm chamber 115 to open and close ports 116 and 117 communicating the upper diaphragm chamber 115 with a vacuum conduit 118 and a pressurized air conduit 120, respectively. The various valves 106, 107, 116 and 117 are actuated in the manner similar to the valves of FIG. 1 and the timing thereof is similar to that shown in FIG. 8 in which pressurized air is applied to the underside of the diaphragm 102 and vacuum is concurrently applied to the upperside, the timing being such that as the diaphragm reaches the lower end of its stroke, the relationships of the valves will be reversed to concurrently apply pressurized air to the upperside and vacuum to the underside.

FIG. 10 illustrates the invention embodied in an internal combustion engine of the four stroke cycle type which comprises one or more cylinders 122. A piston 123 is slidable in the cylinder 122 and is pivotally connected to a connecting rod 124 journalled on an offset crank pin 125 of a crankshaft 126.

A poppet valve 127 is provided to open and close a port 128 opening into an intake manifold 130 into which an explosive gas mixture is admitted. An exhaust valve 131 is also provided to open and close a port 132 opening into an exhaust manifold 133. An ignition system including a spark plug 134 is provided in the cylinder to explode the mixture after it has been compressed by the piston 123. Obviously, the engine could be modified to incorporate a diesel operating principle.

The engine operates through four strokes during each cycle in which firing occurs during each second excursion of the piston 123 or revolution of the crankshaft. That is, as seen in FIG. 11, the intake valve 127 is open during the intake phase from approximately 0° to 180° to intake the explosive mixture while the exhaust valve 131 remains closed. During the compression phase, from 180° to 360°, compression of the explosive mixture takes place with both valves closed. Thereafter, the valves remain closed during the firing phase from 360° to 540°, after which, during the exhaust phase from 540° to 720°, the exhaust valve 131 is opened and the intake valve 127 is closed until the end of the cycle.

According to the present invention, a crankcase section 134 defined by a crankcase 135 and wall partitions 136 between the cylinders (if more than one cylinder is employed) hermetically seal the cylinders from each other. Poppet valves 137 and 138 are provided in the crankcase section 134 to open and close ports 140 and 141 communicating with a source of vacuum and a source of pressurized air, respectively. These may be external sources as described heretofore in connection with FIG. 6 or they may be derived from the motor itself as described in connection with FIG. 7. The valves 137 and 138 are operated in a manner similar to the valves 67 and 68 of FIG. 3 and according to the timing chart shown in FIG. 11. Thus, vacuum is applied to the underside of the piston 123, during each inward stroke (intake or firing) thereof and pressurized air is applied to the underside of the piston as it moves outwardly in its outward (compression or exhaust) stroke.

It will be obvious to those skilled in the art that many variations may be made in the exact construction shown herein without departing from the spirit of this invention. For example, the number of cylinders may be increased or decreased as desired. Also, in the claims appended hereto, the term "cylinder" is intended to include a diaphragm chamber and the term "piston means" is intended to include a diaphragm. Further, the term "vacuum" is intended to mean reduced atmospheric pressure or a reduction in the density of gas or air molecules and the term "fluid under pressure", "gas under pressure," or the like is intended to mean increased fluid or the like pressure or an increase in the density of fluid or the like molecules.

I claim:

1. A motor comprising:

means forming a cylinder, piston means movable in said cylinder, said cylinder and said piston means forming a first chamber on one side of said piston means and a second chamber on the opposite side of said piston means, control means comprising a gas pump driven by said piston, said pump having a vacuum inlet and a gas pressure outlet, and valve means movable to a first condition to connect said inlet to said first chamber and said outlet to said second chamber, said control means thus being effective in said first condition for concurrently applying a constant vacuum in said first chamber and gas under constant pressure in said second chamber to advance said piston means toward one end of said cylinder, said valve means being movable to a second condition to connect said inlet to said second chamber and said outlet to said first chamber, said control means thus being effective in said second condition for concurrently applying gas under constant pressure in said first chamber and a constant vacuum in said second chamber whereby to advance said piston means toward the opposite end of said cylinder.

2. A motor comprising means forming a series of pairs of cylinders, the cylinders in each pair being arranged in end to end relation, and a series of crankcases intermediate the said cylinders of said pairs, a crankshaft rotatably mounted in said crankcases, said crankcases being hermetically sealed from each other and in communication with respective ones of said pairs of cylinders, pistons movable in respective ones of said cylinders, means operatively connecting said pistons to said crankshaft for rotating said crankshaft, said pistons being in different phase relations to each other and each movable between outer dead center and inner dead center relative to said crankshaft, and control means for applying a vacuum to the side of each of said pistons adjacent said crankshaft and for applying gas under pressure to the opposite side of each of said pistons when said pistons substantially reach said outer dead center positions, said control means being responsive to movement of said pistons to said outer dead center positions for applying said vacuum to the side of each of said pistons adjacent said crankshaft and for applying gas under pressure to the opposite side of each of said pistons.

3. A motor comprising means forming a cylinder, a piston in said cylinder, said piston and said cylinder forming a first chamber on one side of said piston and a second chamber on the opposite side of said piston, means for concurrently firing an explosive mixture in said first chamber and for applying a vacuum to said second chamber whereby to drive said piston toward said second chamber, and means for thereafter applying gas under pressure to said second chamber whereby to drive said piston toward said first chamber.

4. A motor comprising means forming cylinder, a piston in said cylinder, said piston and said cylinder forming a first chamber on one side of said piston and a second chamber on the opposite side of said piston, means including valve means in said first chamber for causing said piston to move successively through an intake stroke, a compression stroke, a firing stroke and an exhaust stroke; and means for applying a vacuum to said second chamber during movement of said piston through said intake and firing strokes and for applying a gas under pressure to said second chamber during movement of said piston through said compression and exhaust strokes.

5. A motor as defined in claim 4 wherein said last mentioned means comprises valve means driven by said piston.

6. A motor as defined in claim 4 wherein said first mentioned means forms additional cylinders and additional pistons in said additional cylinders to form additional first and second chambers, said second chambers being hermetically sealed from each other.

* * * * *